US006601522B2

(12) United States Patent
Roxby

(10) Patent No.: US 6,601,522 B2
(45) Date of Patent: Aug. 5, 2003

(54) TOP CHORD STRUCTURE

(75) Inventor: Robert J. Roxby, Portage, PA (US)

(73) Assignee: JAC Patent Company, Johnston, PA (US)

( * ) Notice: Subject to any disclaimer, the term of this patent is extended or adjusted under 35 U.S.C. 154(b) by 0 days.

(21) Appl. No.: 09/920,436

(22) Filed: Aug. 1, 2001

(65) Prior Publication Data

US 2002/0073886 A1 Jun. 20, 2002

Related U.S. Application Data

(60) Provisional application No. 60/222,207, filed on Aug. 1, 2000.

(51) Int. Cl.[7] ..... B61D 11/00

(52) U.S. Cl. ..... 105/355; 105/406.1; 105/404; 296/100.17

(58) Field of Search ..... 105/238.1, 238.2, 105/406.1, 404, 396, 409, 411, 355; 296/100.17, 100.18

(56) References Cited

U.S. PATENT DOCUMENTS

| | | | | | |
|---|---|---|---|---|---|
| 1,649,492 | A | * | 11/1927 | Small | 105/406.1 |
| 2,748,723 | A | | 6/1956 | Swann | 105/406 |
| 2,885,971 | A | * | 5/1959 | Shaver et el. | 105/406.1 |
| 3,051,524 | A | * | 8/1962 | Palmer | 296/100.17 |
| 3,772,997 | A | * | 11/1973 | Heap et al. | 105/406.1 |
| D265,644 | S | * | 8/1982 | Spence | D12/93 |
| 4,561,361 | A | | 12/1985 | Adams | 105/406 R |
| 4,646,653 | A | * | 3/1987 | Balbi et al. | 105/406.1 |
| 4,840,127 | A | | 6/1989 | Tomaka | 105/406.1 |
| 4,911,082 | A | * | 3/1990 | Richmond | 105/244 |
| 5,070,793 | A | | 12/1991 | Kurtz et al. | 105/406.1 |
| 5,335,603 | A | * | 8/1994 | Wirick et al. | 105/406.1 |
| 6,302,031 | B1 | * | 10/2001 | Smith et al. | 105/404 |

* cited by examiner

*Primary Examiner*—S. Joseph Morano
*Assistant Examiner*—Frantz F. Jules
(74) *Attorney, Agent, or Firm*—The BLK Law Group; Blynn L. Shideler; Krisanne Shideler

(57) ABSTRACT

The railcar includes modified side top chord members which allow for increased hauling capacity. Additionally, the side top chord member is designed to improve the loading characteristics of this member. The end top chord members and corner cap member have been designed to minimize the fabrication and assembly process. The end top chord members have been designed to improve the stress distribution through this member. All of these characteristics combine to form an improved top chord structure for the railcar.

8 Claims, 4 Drawing Sheets

TOP CHORD STRUCTURE

This application claims the benefit of U.S. Provisional Patent Application Serial No. 60/222,207, filed Aug. 1, 2000, which is incorporated herein by reference in its entirety.

BACKGROUND OF THE INVENTION

1. Field of the Invention

The present invention relates to a top chord structure for an open top railcar. More particularly, the present invention relates to a side top chord member, an end top chord member and a corner cap for a top chord structure.

2. Background Information

An open top hopper or gondola-type railcar typically comprises a series of side walls, end walls and vertical posts or side stakes that define the basic perimeter of a container for handling a body of material. The side stakes are spaced along the side walls and are designed to strengthen and reinforce the side walls of the container. End posts or stakes may be spaced along the end walls to strengthen and reinforce the end walls of the container. A top chord structure extends along each of the side walls and end walls of the container to further strengthen and stabilize the walls.

In the handling of material, it is often necessary to subject the top chord structure, in particular the side top chord members, to some high localized forces. For example, in unloading the contents of the railcar into a rotary dumper, it is conventional to clamp the side top chord member as the railcar is tilted or turned into an unloading position. Also, it is conventional to apply a shaker to the top chord structure, in particular the side top chord members, of the railcar to agitate the contents of the railcar during the unloading process. Both such operations impose large localized forces on the top chord structure, specifically the side top chord members.

A typical side top chord member construction is a P-shaped profile. Specifically, the side top chord member is a tubular member having a generally rectangular profile and a stem that is integrally connected with the tubular member. The stem is designed to be bolted to the side wall and the side stakes of the railcar to connect the side top chord member to the railcar.

In the past, railcar designers have recognized the need for special side top chord members to accept these unloading operations. U.S. Pat. Nos. 2,748,723, and 4,561,361 disclose hot rolled steel bulb sections which are especially designed to accommodate rotary car dumpers or car shaker devices. While these rolled bulb sections have proven satisfactory for railcars and side top chord members made of steel, they lack sufficient strength and integrity when used for aluminum railcars and side top chord members. U.S. Pat. No. 4,840,127 is an example of a top chord structure designed especially for use in aluminum gondola or hopper cars in which the top chord member is a rectangular, tubular extrusion having a thickened stem portion to better resist bending moments where the side top chord member is fastened to the side walls and side stakes. This top side chord member, while more suitable for aluminum railcars than the rolled bulb section, lacks sufficient strength and integrity for extended use in the rotary or shaker-type car unloading devices. U.S. Pat. No. 5,070,793 (hereinafter "the '793 patent) which is incorporated herein by reference, is an example of a top chord structure designed especially for use in aluminum gondola or hopper cars which is strong, lightweight and suitable for extended use in rotary or shaker-type car unloading devices.

The object of the present invention is to design a side top chord member which maintains the advantages of the '793 patent and which improves the hauling capacity of the railcar and improves the load carrying capacity of the side top chord member. Another object of the present invention is to design all of the components of the top chord structure to minimize fabrication cost and time and to improve the operating characteristics of the individual components.

SUMMARY OF THE INVENTION

The above objects are achieved with a top chord structure according to the present invention. The railcar having the top chord structure according to the present invention includes modified side top chord members which allow for increased hauling capacity. Additionally, the side top chord member is designed to improve the loading characteristics of this member. The end top chord members and corner cap member have been designed to minimize the fabrication and assembly process. The end top chord members have been designed to improve the stress distribution through this member. All of these characteristics combine to form an improved top chord structure for the railcar. These and other advantages of the present invention will be clarified in the description of the preferred embodiments wherein like reference numerals represent like elements throughout.

DESCRIPTION OF THE PREFERRED EMBODIMENTS

Figure 1:
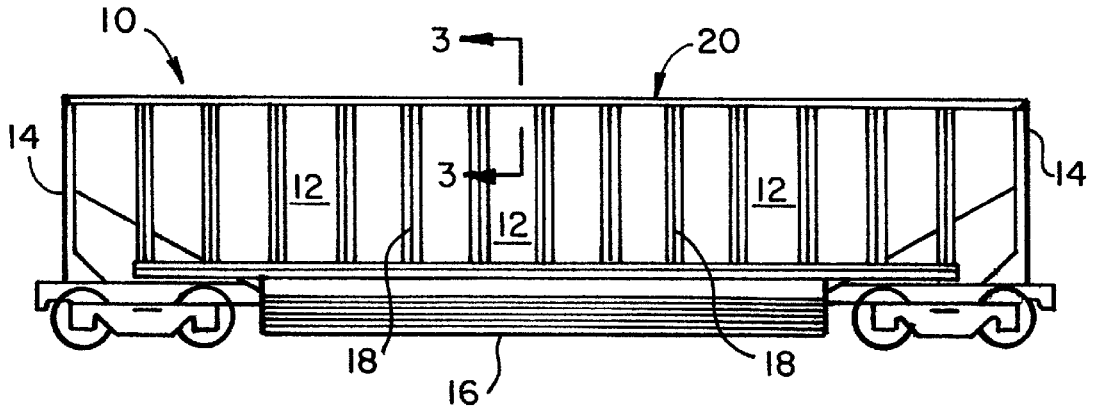
FIG. 1 is an elevational side view of an open top gondola railcar according to the present invention.
Figure 2:
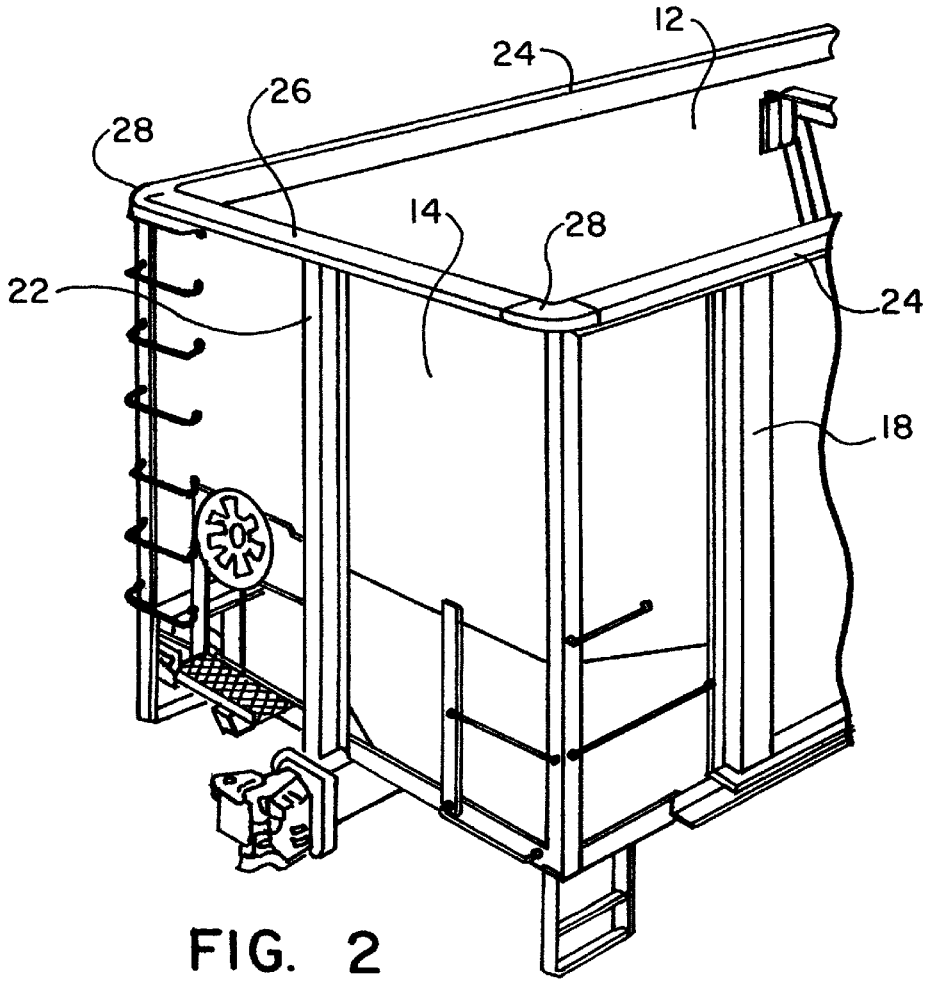
FIG. 2 is a perspective view of an end of an open top gondola car without showing the details of the top chord structure according to the present invention.

The present invention provides a railcar 10 with an improved top chord structure 20 for the open top gondola railcar 10 generally illustrated in FIGS. 1 and 2. The open top gondola railcar 10 has a pair of side walls 12, a pair of end walls 14 and a concave floor structure 16. The side walls 12 are stiffened and reinforced by a plurality of spaced, parallel, vertical side posts or side stakes 18. Similarly, the end walls 14 are stiffened and reinforced by end posts or stakes 22. The top chord structure 20 extends along the top of the side walls 12 and the top of the stakes 22 and along end walls 14 as shown in FIGS. 1 and 2. The top chord structure 20 includes side top chord members 24 extending along each side wall 12, end top chord members 26 extending along the end walls 14 and corner cap members 28 interconnecting the side top chord members 24 and the end top chord members 26. The structure of the individual components of the top chord structure 20 are shown in detail in FIGS. 3–9 and are described below.

Figure 3:
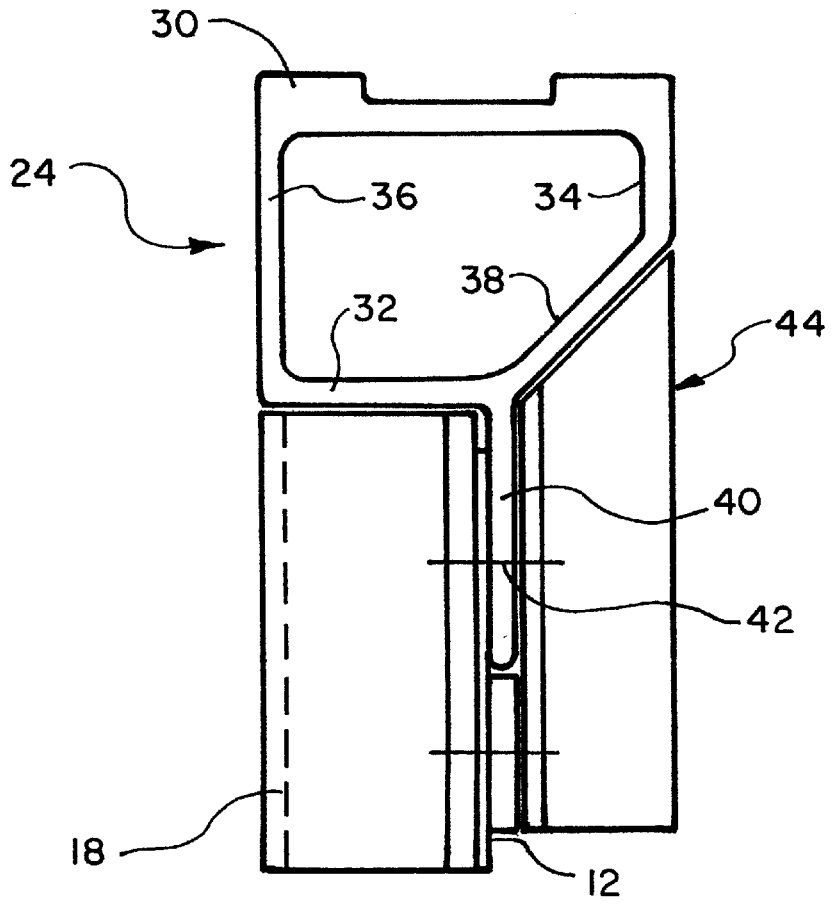
FIG. 3 is a cross-sectional view of a side top chord member of the top chord structure attached to the railcar according to the present invention.
Figure 4:
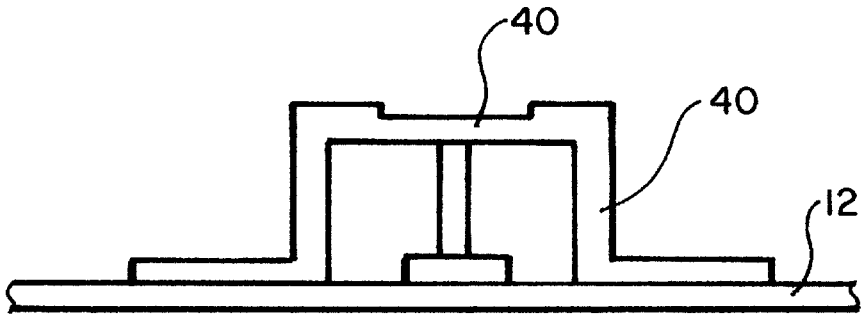
FIG. 4 is a cross-sectional view of two embodiments of a side top chord support member according the present invention.
Figure 5:
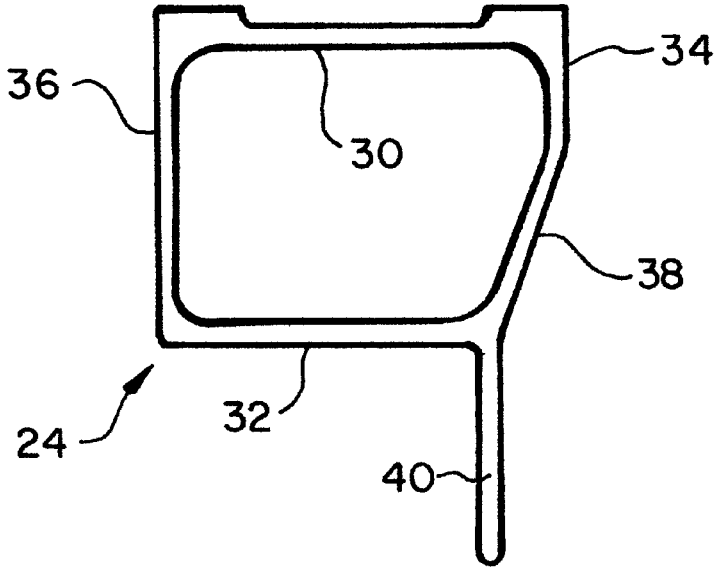
FIG. 5 is a cross-sectional view of a side top chord member according to the present invention.

Referring to FIGS. 3–5, the side top chord members 24 according to the present invention are aluminum extrusions having a tubular configuration. The aluminum extrusion has a top wall 30 and a bottom wall 32 parallel to each other. The side top chord member 24 includes an upper inner side wall 34 and an outer side wall 36 parallel to each other. An angled lower inner side wall 38 extends from the upper inner side wall 34 to the bottom wall 32 to complete the tubular configuration. A lower attachment stem or leg 40 is used to fasten the side top chord member 24 to the side walls 12 and side stakes 18 with rivets 42 or other suitable fasteners as known in the art. The bottom wall 32 of the side top chord member 24 bears directly on the top of the side stakes 18. The top wall 30 may include an integral wear plate, as illustrated, which is described in greater detail in the '793 patent. Additionally, the thicknesses of the walls and the aluminum types appropriate for extrusion are also set forth in the '793 patent. The modification or advantages of the side top chord member 24 is the relative increase of the top wall 30 relative to the bottom wall 32. The extrusion is designed such that the top wall 30 has a greater width than the bottom wall 32 which allows shallower side stakes 18 to be used and increases the load capacity of the side top chord member 24. Being able to use shallower side stakes 18 than prior art railcar designs allows the total railcar width to be increased and the associated hauling capacity of the railcar 10 to be appropriately increased. This design increases the section properties of the side top chord member 24 while maintaining or even decreasing the effective bottom width of the section. This design allows for an increased load carrying capacity of the extruded side top chord member 24. As shown in FIG. 3, the inside of the top chord member 24 can be provided with a top chord support member 44 in an area below the lower inner side wall 38 of the side top chord member 24. The support member 44 can be in the form of a T-stake or C-channel and is intended to limit rotation of the side top chord member 24 during use of the rotary or shaker type car unloading devices. Alternative T and C-shaped configurations for the support member 44 are both shown in FIG. 4. It is also anticipated that the support member 44 can be formed as the same section as an outside stake section for ease of fabrication. These supports can be placed along the side top chord member 24 as needed.

As discussed above, the side top chord member 24 of the present invention increases the section property of the side top chord member 24, and allows the railcar 10 to be constructed to haul heavier pay loads. Specifically, the shallower side stake 18 that can be utilized will increase the hauling capacity of the railcar 10 by allowing the side walls 12 to be moved out farther relative to existing car types.

Figure 6:
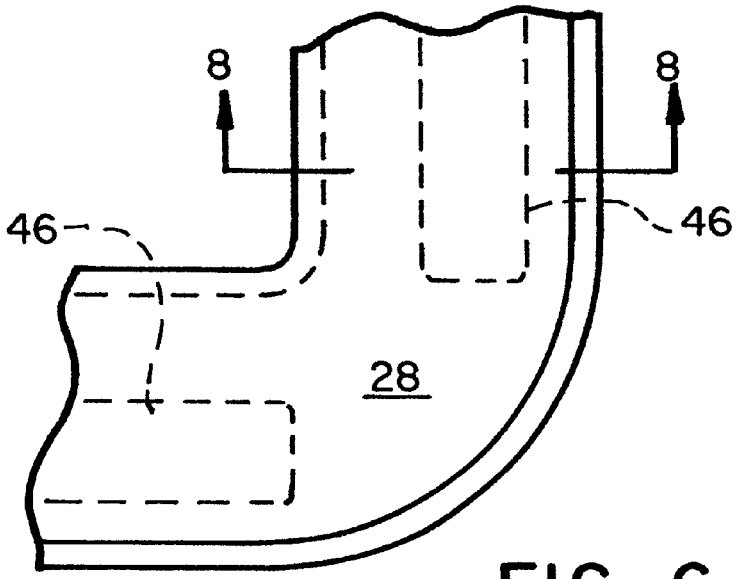
FIG. 6 is a top view of a corner cap member of the top chord structure of the present invention.
Figure 7:
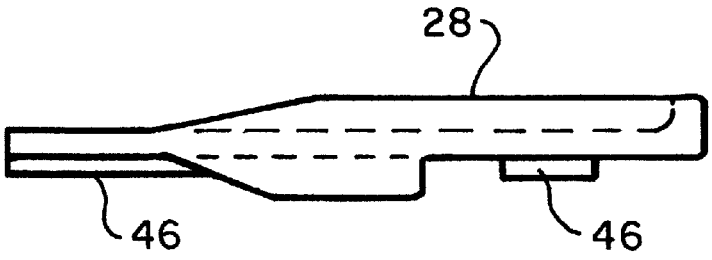
FIG. 7 is a side view of the corner cap member illustrated in FIG. 6.
Figure 8:
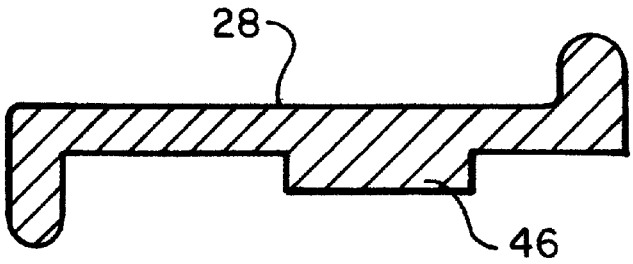
FIG. 8 is a cross-section of the corner cap member illustrated in FIGS. 6 and 7.

FIGS. 6–8 illustrate the corner cap member 28 of the present invention that is specifically designed to eliminate the need for using filler bars or filler pieces when attaching the side top chord member 24 to the end top chord member 26. As will be appreciated by those of ordinary skill in the art, the corner cap member 28 will couple the side top chord member 24 with the end top chord member 26 in the four corners of the railcar 10. The corner cap member 28 of the present invention is similar to existing corner cap members except for the addition of integral filler blocks 46 on the underside thereof which correspond to the top wall portions of both the side top chord member 24 discussed above and the end top chord member 26 discussed in connection with FIG. 9 below. The integral filler block 46 eliminates the need for using separate aluminum filling bars when attaching the side top chord member 24 to the end top chord members 26. Eliminating the additional parts reduces the aluminum costs, reduces the fabrication time and reduces the number of parts associated with the railcar 10 resulting in an overall cost reduction for the railcar 10.

Figure 9:
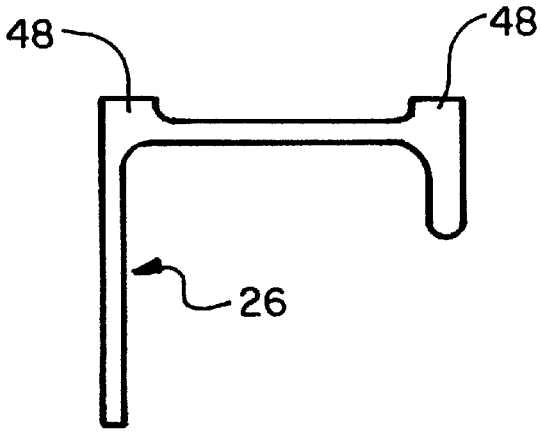
FIG. 9 is a cross-section of an end top chord member of the top chord structure according to the present invention.

FIG. 9 illustrates an end top chord member 26 according to the present invention which is specifically designed to reduce the material costs associated with prior art end top chord members. Additionally, the end top chord member 26 is designed to be utilized with the corner cap member 28 discussed above. The end top chord members 28 are aluminum extrusions which include integral wear bar type extensions 48 on the top surface of the end top chord members 26. The extensions 48 are used in order that the block 46 of the corner cap member 28 is incorporated easily in to the railcar 10. The rounded edges on the end top chord member 26 improved the extrusion process and improve the distribution of stresses when the end top chord member 26 is loaded. This configuration of the end top chord member 26 reduces the material used for the extrusion over prior art end top chord members and, therefore, reduces the cost per railcar 10. This specific design is intended to improve the extrusion process while allowing the resulting end top chord member 26 to be utilized with the corner cap member 28 with integral blocks 48.

In summary, the railcar 10 of the present invention includes an improved top chord structure 20. The top chord structure 20 includes modified side top chord members 24 which allow for increased capacity. Additionally, the side top chord member 24 is designed to improve the loading characteristics of this member. The end top chord members 26 and corner cap members 28 have been designed to minimize the fabrication and assembly process and the end top chord members 26 have been designed to improve the stress distribution through this member. All of these characteristics combine to form an improved top chord structure 20 for the railcar 10 of the present invention.

It will be apparent to those of ordinary skill in the art that various modifications may be made to the present invention without departing from the spirit and scope thereof. The described embodiments shown in the figures are illustrative of the present invention and are not intended to be restrictive thereof.

What is claimed is:

1. A top chord structure for a railcar having two opposed side walls, the side top chord structure including a pair of side top chord members attached to the side walls of the railcar, each side top chord member formed as a tubular extrusion having a top surface and a parallel bottom surface, wherein the top surface is wider than the bottom surface, and further including a corner cap member having at least one integral filler block, wherein the filler block is received in a recess formed in the top surface of the side top chord member.

2. The top chord structure of claim 1 further including an end top chord member having a recess in a top surface thereof which receives an integral filler block of an adjacent corner cap member.

3. The side top chord structure of claim 2 wherein an outer surface of the corner cap member which is spaced farthest from and substantially parallel to the side wall is substantially flush with an outer surface of the side top chord member.

4. The side top chord structure of claim 1 wherein an outer surface of the corner cap member which is spaced farthest from and substantially parallel to the side wall is substantially flush with an outer surface of the side top chord member.

5. A open top gondola railcar comprising:

a pair of side walls;

a pair of end walls;

a plurality of substantially parallel, spaced side stakes reinforcing the side walls;

side top chord members extending along each side wall, each side top chord member formed as a tubular extrusion having a top surface and a parallel bottom surface and a pair of side surfaces extending there between, wherein the top surface is wider than the bottom surface, and the bottom surface bears on a top of the side stakes; and a plurality of support members coupled to the side wall and the side top chord member in an area below a side surface of the side top chord member opposite from the side of the side wall containing the side stakes; and a corner cap member having at least one integral filler block, wherein the filler block is received in a recess formed in the top surface of the side top chord member.

6. The railcar of claim 5 wherein an outer surface of the corner cap member which is spaced farthest from and substantially parallel to the side wall is substantially flush with an outer surface of the side top chord member.

7. The railcar of claim 5 wherein an outer most surface of each side stake is substantially vertically aligned with a side surface of the side top chord member.

8. An open top gondola railcar comprising:

a pair of side walls;

a pair of end walls;

a plurality of substantially parallel, spaced side stakes reinforcing the side walls;

side top chord members extending along each side wall, each side top chord member formed as a tubular extrusion having a top surface and a parallel bottom surface and a pair of side surfaces extending there between, wherein the top surface is wider than the bottom surface, and the bottom surface bears on a top of the side stakes; and a plurality of support members coupled to the side wall and the side top chord member in an area below a side surface of the side top chord member opposite from the side of the side wall containing the side stakes wherein an innermost surface of each support member is substantially vertically aligned with an inner most portion of a side surface of the side top chord member.

* * * * *